US006213961B1

(12) United States Patent
Reinsma

(10) Patent No.: US 6,213,961 B1
(45) Date of Patent: Apr. 10, 2001

(54) IMPLEMENT HOLDER FOR USE BY MOTOR DISABLED PATIENTS

(75) Inventor: Homme Johannes Reinsma, Goutum (NL)

(73) Assignee: Exakt Fijnmechanika B.V., Dokkum (NL)

( * ) Notice: Subject to any disclaimer, the term of this patent is extended or adjusted under 35 U.S.C. 154(b) by 0 days.

(21) Appl. No.: 09/319,357

(22) PCT Filed: Dec. 8, 1997

(86) PCT No.: PCT/NL97/00673

§ 371 Date: Jul. 21, 1999

§ 102(e) Date: Jul. 21, 1999

(87) PCT Pub. No.: WO98/24641

PCT Pub. Date: Jun. 11, 1998

(30) Foreign Application Priority Data

Dec. 6, 1996 (NL) ..... 1004713

(51) Int. Cl.[7] ..... A61H 1/00
(52) U.S. Cl. ..... 601/80; 401/195
(58) Field of Search ..... 601/33, 40, 46, 601/70, 80, 81; 401/52, 195; 607/146

(56) References Cited

U.S. PATENT DOCUMENTS 5,165,814 * 11/1992 Buda ..... 601/80
5,244,299 9/1993 Chu .
5,651,157 * 7/1997 Hahn ..... 601/70

FOREIGN PATENT DOCUMENTS 1 611 549 1/1971 (DE) .
92 02 950 5/1993 (DE) .
296 17 289 1/1997 (DE) .
569 638 11/1993 (EP) .

OTHER PUBLICATIONS

Patent Abstracts of Japan, vol. 015, No. 281 (p–1228), Jul. 17, 1991 and JP 03 096823 (Shinko Electric Co., Ltd.), Apr. 22, 1991.

* cited by examiner

*Primary Examiner*—William E. Kamm
(74) *Attorney, Agent, or Firm*—Merchant & Gould P.C.

(57) ABSTRACT

A holder for a wiring implement, such as a ball-point cartridge, eating implements, such as a fork, a knife or like implement. The holder is arranged for holding the implement (12) and comprises means (5, 6, 8, 9) for vibrating the housing (1) with a frequency in the order of 50 to 100 Hz and an amplitude of the force causing the vibration in the order of 0.3 to 2.5 Newton. Preferably, the frequency and amplitude are adjustable. The vibrating holder enables greatly improved motor control of the implement in question for many patients.

11 Claims, 1 Drawing Sheet

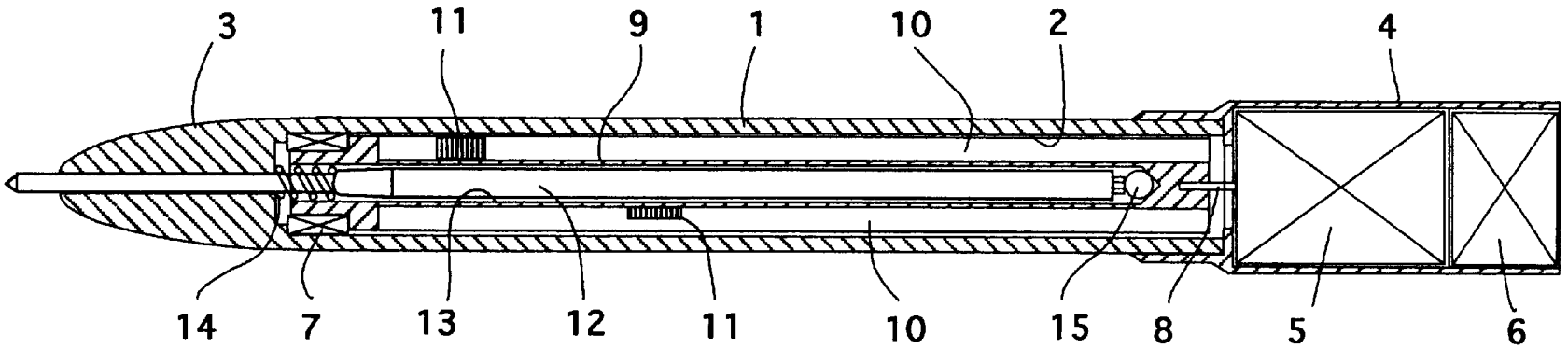
3
11
9
1
10
2
4
14
7
13
12
11
10
15
8
5
6

IMPLEMENT HOLDER FOR USE BY MOTOR DISABLED PATIENTS

FIELD OF THE INVENTION

This invention relates to an aid for mitigating certain discomforts resulting from diseases, in particular muscular diseases such as Parkinson's disease, but also rheumatism. Although the aid according to the invention can be employed in several fields, the following description will be focused on a writing implement for Parkinson patients.

BACKGROUND OF THE INVENTION

Characteristic symptoms of Parkinson's disease, which, for that matter, need not occur all at the same time, include: shaking, muscular rigidity and paucity of movement. This does not involve palsy but a (temporary) disturbance of muscle controls and of muscle coordination. The cause is degeneration of areas in the brain, specifically the "black nuclei" and the "basal brain", as a result of which insufficient neurotransmitter (dopamine) is produced. These areas of the brain are of vital importance for a smooth performance of movements, i.e. for an effortless initiation of a movement, proper control during the movement, and the termination of the movement. These areas further ensure that when the flexors of a limb are to contract, the extensors relax at the same time. This interaction is of importance for a smooth performance of to-and-fro movements, as during eating, writing, handiwork, getting dressed and undressed. These are the first movements to present problems in Parkinson's disease. When the performance of the movements no longer proceeds automatically, it will be attempted to perform them more deliberately, which requires an effort.

This most conspicuous symptom of Parkinson's disease, i.e. shaking (tremor), involves an involuntary rhythmic movement of a number of muscles, mostly of one or both hands. This movement is most clearly visible if the hand is at rest. The frequency of this so-called rest tremor is 4–7 Hz. During sleep the tremor does not occur and emotions may aggravate the tremor distinctly.

Another symptom is muscular rigidity. Such rigidity, also referred to as hypertonia, arises in that the muscles are continuously in a state of slight contraction and this rigidity must be overcome before a movement can be initiated.

The third symptom mentioned, paucity of movement (hypokinesia), is a result of the muscular rigidity. Fine to-and-fro movements, as in tying shoe-laces, are more difficult to perform.

There are not as yet any medicines to cure the disease. Treatment is primarily focused on removing complaints. Thus, the deficiency of neurotranamitter (such as dopamine) is supplemented by medicines. Further, the symptoms of the disease can be suppressed by surgical intervention in the brain, which is obviously a hazardous enterprise.

As already observed in the foregoing, writing can present problems. Indeed, writing is a complex process that proceeds automatically under normal circumstances. It refires the hand muscles to be supple and a proper coordination of the fine movements. In Parkinson's disease this coordination is disturbed, and patients experience this as a major drawback.

Accordingly, a need exists for writing implements whereby this drawback is eliminated as far as possible. A known proposal towards facilitating writing for patients suffering from muscular diseases, including Parkinson patients, concerns the ergonomics of the writing pen. A slender pen is more difficult to hold and aggravates tremor. Using a pen with a spherical grip which can be embraced by the hand with a good fit enables writing from the wrist. Another known proposal involves a so-called soft grip, i.e. a flexible sleeve which can be fitted over a pen and has a lobed configuration, viewed in cross section, which urges the writing fingers in the correct position and provides a proper hold without effort.

German patent application 1611549 (Brown et al) and European patent application 0569638 (Hart Enterprises) disclose marker or decoration pens in the toy domain, which are provided with means for setting the pen into vibration.

They have in common that the eccentric weight is provided at the rear end of the pen and that an eccentric oscillating movement is thereby generated also at the rear end of the drawing implement, such that when the pen is moved along a straight line over the paper, the entire pen oscillates, with the part held by the fingers being the fulcrum, and the writing end makes an opposite oscillating movement. If the pen, as is commonly done, in held obliquely to the paper and a pulling movement over the paper is performed, the result will be a decorative, repetitive loop pattern.

The known pens are neither designed nor suitable for producing normal handwriting. Writing with them is even virtually impossible.

SUMMARY OF THE INVENTION

The object of the invention is to provide an aid for reducing the inconveniences described in the foregoing, which result from tremor, muscular rigidity and hypokinesia, which inconveniences occur in writing, eating, handling certain tools, such as a screwdriver, etc. In the embodiment as a writing implement, the aid must enable a normal writing result as far as possible, it must be a proper fit in the hand, and it is desired for the external configuration to correspond as much as possible to that of normal writing implements. Further, especially with regard to holders for writing implements, it should be possible to make use of standard parts as much as possible, and the use of the writing implement should not require the user to perform any complex operations.

This is accomplished according to the present invention by providing a holder for an implement, such as a writing implement, such as a ball-point cartridge, an eating implement, such as a fork, a knife or the like, arranged for holding the implement, comprising means for causing the holder to vibrate with a frequency in the order of 50 to 100 Hz and an amplitude of the force causing the vibration in the order of 0.3 to 2.5 Newton.

Surprisingly, by causing the implement holder to vibrate, the controllability of the implement is highly improved for many patients.

The invention is based on the insight that, among other things, the tremor of parts of the body as is inherent to Parkinson's disease decreases considerably when such parts come into contact with a mechanical vibration, in particular if this vibration emanates from the object to be controlled.

More particularly, tremor in Parkinson patients has a frequency of 4–7 Hz. while objects by which a decrease of the tremor can be effected have a much higher frequency. Accordingly, no damping by vibration in opposite phase can be involved. Possible explanation are that vibrations have a relaxing effect on stiffened muscles, and that the tremor is drowned out, and hence smoothed, by vibrations with a higher frequency than the tremor. Further, it is known in general in massaging that stiffened muscles can be stimulated by electrical pulses and also by rhythmic massage. Good results are achieved with a massaging frequency of 80 Hz. The rhythmic ticking of a metronome at a frequency of 60–70 Hz also has a favorable effect on the movements of Parkinson patients. Such rhythmic stimuli, however, are not administered by an object to be controlled.

Preferably, the frequency and amplitude mentioned are settable.

For instance when the holder is applied in combination with a writing implement, such as a ball-point refill or cartridge, and a Parkinson patient takes the thus designed, vibrated pen in his hand, what happens is that, instead of the tremor becoming worse as the patient makes a forced effort to assume the writing posture, the vibrating holder has a calming influence on the hand, so that gripping the pen and writing with it leads to considerably better writing results. The same applies if the holder is used in combination with other implements, for instance a fork. The patient's efforts to hold the fork properly usually lead to a stronger tremor and hence to spilling and the like. By the use of the vibrating holder according to the invention, the tremor is at the least reduced and this will lead to a more relaxed eating behavior.

Preferably, the means for setting the housing into vibration comprise a source of oscillation and a mass movable relative to the housing by that source, while the area in which the mass can oscillate in the housing is adjustable.

In further elaboration of the invention, the holder can be provided with a hollow sleeve accommodated coaxially within the holder housing, which sleeve is bearing-mounted at the front and at the rear of the housing and is coupled to the rotary shaft of a driving motor which is accommodated with a source of energy in a motor housing connected with the holder housing, the sleeve being provided with at least one eccentric weight which, being adjustable over the length and in circumferential direction of the sleeve, is fixable thereon.

By making the holder at least partly detachable, it is easy, in the ball-point embodiment, to replace an empty ball-point cartridge. In the embodiment as a fork holder a fork with an adapted handle can easily be mounted in the holder from the front.

Further, by displacing the eccentric weight and varying the frequency, it is possible for the vibration produced to be adjusted to the user's personal need in order to arrive, for instance in the case of the ball-point embodiment, at an optimum writing result. The required force of vibration and the point where it is generated differs from one patient to another, for instance adjacent the fingertips, or some centimeters removed therefrom, adjacent the ball of the hand. This must be determined experimentally. It is observed that small variations in the frequency have little influence on the writing result.

In a preferred embodiment of the invention, the sleeve is provided with circumferentially distributed axial grooves and use is made of two eccentric weights of the same cross section as the grooves, so that the weights can be clamped in the grooves at selected positions.

In order to avoid a ball-point cartridge placed in the sleeve rotating fully along with the sleeve, which has an adverse effect on the ink supply, the rear end of the sleeve can be designed as a seat for a ball against which the rear end of the ball-point cartridge can be supported. For a fork handle or the like a similar provision can be made.

In the use of the writing implement according to the invention, as a result of a vibrating pen being set to paper, a dynamic, rather than a static, friction will have to be overcome, so that the writing movement is initiated more easily. This last is important for Parkinson patients.

DETAILED DESCRIPTION OF THE INVENTION

To clarify the invention, a preferred exemplary embodiment of the holder for an implement, in particular writing implements, will be described with reference to the drawing.

The drawing shows an axial cross-sectional view of a holder for a ball-point refill or cartridge of a commercially available type.

According to the drawing, the holder comprises a housing 1 with an axial receiving space 2 for the implement and with a front end or tip 3. Located at the rear end of housing 1 is a motor housing 4, in which a motor 5 and a battery 6 or other source of energy are diagrammatically indicated. Rotary motors of small dimensions which are supplied by standard batteries are also commercially available in various designs. By means of a slide bearing 7 at the front and the motor shaft 8 at the rear, a hollow sleeve 9 is rotatably bearing-mounted in the housing 1. By the motor shaft 8 the rear end of the sleeve 9 is centered in the holder housing 1.

The sleeve 9 is provided with an axial bore 13 of longitudinal grooves 10 distributed in circumferential direction of the sleeve. Two eccentric weights 11 are fixed in such longitudinal grooves 10 by clamping. If the sleeve 9 is driven by the motor, the housing 1 is caused to vibrate.

A ball-point cartridge 12 of a conventional model is received in the bore 13 of the sleeve 9. The cartridge reaches by the writing end thereof through a corresponding passage in the tip 3 of the holder hoing 1 and is held pressed against a ball 15 at the rear end by a helical spring 14, which ball 15 rests against a conical seat formed in the bottom of the sleeve. This prevents the cartridge 12 from revolving along with the motor shaft 8.

It has been determined experimentally that in an aid 5according to the invention designed as a ball-point pen, the frequency of oscillation should preferably be adjustable at least between 50 and 100 Hz and that in general optimum results are achieved with about 60–80 Hz.

With two eccentric weights, each of about 3 grams, each separately displaceable in radial and axial direction in the front half of the pen, both the form of the oscillation and the amplitude of the force causing the oscillation can be set. The amplitude of the force causing the vibration is adjustable between about 0.3 N and 2.5 N, given immovable fixation of the holder. In the case of free movability of the holder, this amplitude leads to an oscillating movement of the holder corresponding to the amplitude mentioned and the mass of the holder.

The diameter of the housing should preferably be between 16 and 18 mm and the tip should preferably be narrow (slender).

What is claimed is:

1. A holder for an implement, such as a writing implement, such an a ball-point cartridge, an eating implement, such as a fork, a knife or the like, arranged for holding the implement (12), comprising means (5, 6, 8, 9) for vibrating the holder (1) with a frequent in the order of 50 to 100 Hz and an amplitude of the force causing the vibration in the order of 0.3 to 2.5 Newton.

2. A holder according to claim 1, characterized in that said frequency and amplitude are settable.

3. A holder according to claim 1, characterized in that the means (5, 6, 8, 9) for vibrating the housing (1) comprise a source of oscillation (5, 6, 8, 9) and a mass (11), movable relative to the housing (1) by that source, while the area in which the mass (11) can oscillate in the housing is is adjustable.

4. A holder according to claim 1, characterized in that the holder comprises a hollow sleeve (9) accommodated coaxially within a holder housing (1), which sleeve (9) is bearing-mounted at the front and at the rear of the housing (at 7 and 8, respectively) and is coupled to the rotary shaft (8) of a driving motor (5) which is accommodated, along with a source of energy (6), in a motor housing (4) connected with the holder housing (1), while at least one eccentric weight (11), being adjustable over the length and in circumferential direction of the sleeve (9), is fixable on said sleeve (9).

5. A holder according to claim 4, characterized in that the sleeve (9) is provided with circumferentially distributed axial grooves (10) and use is made of two eccentric weights (11) of the same cross section as the groove es (10), so that the weights (11) can be clamped in the grooves (10) at selected positions.

6. A holder according to claim 4, characterized in that the sleeve (9) in designed with an axial hollow space (13) for receiving an implement such as a hall-point cartridge (12) and the rear of the space (13) is bounded by a seat for a ball (15) against which the rear end of the ball-point pen (12) can be supported.

7. A holder according to claim 1, characterized in that the frequency of oscillation is settable at about 60–80 Hz.

8. A holder according claim 1, characterized in that amplitude of the force causing the vibration is adjustable to a minimum value of 0.5 K.

9. A holder according to claim 1, characterized in that the amplitude of the force causing the is vibration is settable at about 2.5 N.

10. A holder according claim 1, characterized in that the diameter of the holder in a grip area for holding the holder in use is between 16 and 18 mm.

11. A holder according to claim 1, characterized by a grip area for holding the holder in use, the grip area extending at least partly around an area within which the means (5, 6, 8, 9) for vibrating the housing are located.

* * * * *